US005424758A

United States Patent [19]

Onishi et al.

[11] Patent Number: 5,424,758

[45] Date of Patent: Jun. 13, 1995

[54] THERMAL HEAD HAVING A TROPEZOIDAL GLAZE LAYER

[75] Inventors: Hiroaki Onishi; Katsuhiko Shimizu, both of Kyoto, Japan

[73] Assignee: Rohm Co., Ltd., Kyoto, Japan

[21] Appl. No.: 904,492

[22] Filed: Jun. 25, 1992

[30] Foreign Application Priority Data

Jul. 19, 1991 [JP] Japan ..... 3-179858
Jul. 22, 1991 [JP] Japan ..... 3-180784
Jul. 22, 1991 [JP] Japan ..... 3-180785

[51] Int. Cl.[6] ..... B41J 2/335; B41J 2/32; B41J 2/325

[52] U.S. Cl. ..... 347/200; 29/611

[58] Field of Search ..... 346/76 PH; 29/611; 358/296

[56] References Cited

U.S. PATENT DOCUMENTS 4,707,708 11/1987 Kitagishi et al. ..... 346/76 PH
4,743,923 5/1988 Nishiguchi et al. ..... 346/76 PH
5,014,135 5/1991 Ijuin et al. ..... 346/76 PH
5,162,814 11/1992 Shirakawa et al. ..... 346/76 PH

FOREIGN PATENT DOCUMENTS 0395001 4/1990 European Pat. Off. .
0427212A2 11/1990 European Pat. Off. .
2482007 5/1981 France .
57-103863 6/1982 Japan .
62-97863 5/1987 Japan .
63-191655 8/1988 Japan .
2-38065 2/1990 Japan .

*Primary Examiner*—Huan H. Tran
*Attorney, Agent, or Firm*—Oliff & Berridge

[57] ABSTRACT

A thermal head is suitable for use in electronic equipments such as printers and the like and comprises a partially or entirely trapezoidal partial-glaze layer formed on the top of an insulation substrate at one edge, a resistive film layer formed on the partial-glaze layer a pattern of common and discrete electrodes formed on the resistive film layer on the opposite sides of the partial-glaze layer except the area thereof that corresponds to the top of the partial-glaze layer, and a protective film layer formed to cover the resistive film layer and electrodes. In such a manner, a heating section is provided on the top of the trapezoidal partial-glaze layer. The heating section extends further upwards from the surrounding area. Unnecessary dispersion of pressure to the surrounding area other than the heating section can be avoided to improve the printing efficiency and speed.

19 Claims, 9 Drawing Sheets

THERMAL HEAD HAVING A TROPEZOIDAL GLAZE LAYER

BACKGROUND OF THIS INVENTION

1. Field of the Invention

The present invention relates to a thermal head having an improved printlag efficiency, electronic equipments with such a thermal head, such as printers, word processors, facsimile machines and plotters, and a process of making such a thermal head.

2. Description of the Related Art

The thermal heads can be classified into partial-glaze type, double-partial-glaze type and true-edge type. As shown in FIG. 1, the partial-glaze type thermal head comprises an insulation substrate 11, a partial glaze layer 12 formed on the substrate adjacent to its edge portion, having a width equal to about 300–1200 microns and an outwardly convex configuration, a resistive film layer 13 formed over the partial glaze layer 12, common and discrete electrodes 15 and 16 formed on the resistive film layer 13 at the top positions of the glaze layer 12 opposite to each other to form a heating section 14 on the top of the glaze layer 12 and a protective film 17 covering these layers as a whole. The double-partial-glaze type thermal head is one similar to the partial-glaze type thermal head except that a portion of the glaze layer 12 placed at the heating section 14 is formed into an upwardly convex configuration by glaze etching or the like, as shown in FIG. 2.

The true-edge type thermal head is one where in the glaze layer 12 and the heating section 14 are formed to cover the edge of the insulation substrate 11, as shown in FIG. 3. FIG. 4 shows a modification of the thermal head shown in FIG. 3, in which the edge portion of the insulation substrate 11 is slantingly cut to provide a slope 11*b* adjoining the top face 11*a* of the insulation substrate 11 and an edge face 11*c* adjoining the slope 11*b* and extending perpendicular to the top face 11*a*. Glaze layers 12*a*, 12*b* and 12*c* are formed over the respective races 11*a*, 11*b* and 11*c*. The heating section 14 is formed at the slope 11*b*.

As shown in FIG. 5, the thermal transfer is carried out against an ink ribbon 18 and a sheet to be printed on 19 which are held between the glaze layer 12 and a rubber platen 20, with tile ink ribbon 18 being urged to the sheet to be transferred 19 by the glaze layer 12. Since tile top of the glaze layer 12 exerting the maximum urging force to the ink ribbon 18 includes the heating section 14, the heating and urging of the ink ribbon 18 will be simultaneously made on the thermal transfer. In order to print a rough sheet and to improve the printing efficiency, the thermal head requires that a heating resistor portion concentrates its pressure onto tile ink ribbon, the sheet to be printed on and the platen. For example, if a rough sheet is to be printed, a letter pattern is thermally cut away from the ink ribbon 18. The cut letter pattern is then transferred to the sheet to be printed 19 under tile urging force from the glaze layer 12. In the partial-glaze and double-partial-glaze type systems, however, an area at which the glaze layer 12 having the heating section 14 engages the rubber platen 20 is relatively large. This raises a problem in that the pressure from the heating section 14 is not sufficiently concentrated onto the ink ribbon 18. Although the true-edge type system (FIG. 3) has been developed to overcome such a problem, it cannot presently provide a sufficient advantage since the substrate has an undesirable thickness equal to about 2 mm. A common problem with the aforementioned systems of the prior art is that when a substrate is to be worked at its side face to print a plurality of thermal heads thereon, they cannot be formed at the same time. As a result, the manufacturing cost per thermal head will be increased.

SUMMARY OF THE INVENTION

It is therefore an object of the present invention to provide a thermal head which can be inexpensively produced with an improved printing efficiency and which can concentrate the pressure onto the heating section.

Another object of tile present invention is to provide a process of easily producing a plurality of such thermal heads at a time.

To this end, the present invention provides a thermal head comprising an insulation substrate, a trapezoidal partial-glaze layer formed on the insulation substrate at one edge, a resistive film layer formed on the trapezoidal partial-glaze layer, common and discrete electrodes formed on the resistive film layer respectively at the opposite sides of the trapezoidal partial-glaze layer, thereby forming a heating section on the top of the trapezoidal partial-glaze layer, and a protective film layer formed over the heating section and the common and discrete electrodes.

In such an arrangement, the heating section on the top of the trapezoidal partial-glaze layer greatly extends outwardly from the remaining head portions. Unnecessary dispersion of pressure to the head portions other than the heating section can be avoided. As a result, necessary pressure can be concentrated only onto the heating section to improve the printing efficiency. This also improves the transmission of heat to the ink ribbon and others such that any unnecessary heat accumulation can be avoided. This speeds up the printing.

The present invention also provides a process of making such a thermal head, comprising the steps of forming a curved partial-glaze layer on an insulation substrate, mechanically cutting the partial-glaze layer at the opposite sides thereof by any suitable manner such as laser cutting to form a trapezoidal partial-glaze layer, rounding the corners of the trapezoidal partial-glaze layer, forming a resistive film and an electrode section on the rounded trapezoidal partial-glaze layer and finally forming a protective film layer over the heating and electrode sections.

In accordance with the process of the present invention, a thermal head including a partially or entirely trapezoidal partial-glaze layer can be easily mass-produced.

More particularly, an upwardly convex partial-glaze layer is first formed on an insulation substrate, as in the prior art. The curved partial-glaze layer is then cut away at the opposite sides respectively adjacent to the center and edge of the substrate as by laser to form the partial-glaze layer into a trapezoidal configuration. The corners of the trapezoidal partial-glaze layer are then rounded as by re-burning or reheating. This increases the smoothness In the trapezoidal partial-glaze layer so that the pattern formation can be more easily facilitated and the configuration of the heating section can be stabilized. The top of the trapezoidal partial-glaze layer is coated sequentially with the resistive film layer, common electrode and discrete electrode. Thereafter, the protective film layer is formed over tile heating section (top of the trapezoidal partial-glaze layer), common electrode and discrete electrode. In such a manner, the thermal head can be provided with the heating section which extends upwardly from the other surrounding head portions to provide a sufficient concentration of pressure at the heating resistor section. By taking the half-cutting (non-through cutting) and re-heating (re-burning) steps, a plurality of thermal heads can be fabricated in the same insulation substrate with reduction of the manufacturing cost for each thermal head.

The present invention further provides a thermal head comprising an insulation substrate, a partial-glaze layer formed on the insulation substrate at one top edge with part of the partial-glaze layer being shaped into a trapezoidal configuration, a resistive film layer formed over the trapezoidal partial-glaze layer part, common and discrete electrodes formed on the resistive film layer at the area other than the trapezoidal partial-glaze layer part, thereby providing a heating section on the top of the trapezoidal partial-glaze layer part, and a protective film layer formed over the heating section and common and discrete electrodes. It is preferred that the trapezoidal partial-glaze layer part has a height ranged between 5 microns and 50 microns.

In such an arrangement, the heating section on the top of the trapezoidal partial-glaze layer part extends further outwards from the remaining head portions. Unnecessary dispersion of pressure to tile head portions other than the heating section can be avoided. As a result, necessary pressure can be concentrated only onto the heating section to improve the printing efficiency. This also improves the transmission of heat to the ink ribbon and other parts such that any unnecessary heat accumulation can be avoided. This speeds up the printing. Since the height of the trapezoidal partial-glaze layer part is equal to or larger than 5 microns, an Increased pressure will be exerted onto the heating section. Further, since the height of the same trapezoidal partial-glaze layer part is equal to or smaller than 50 microns, it is not likely to be broken by the increased pressure.

The present invention further provides a thermal head comprising an insulation substrate, a partial-glaze layer formed on the top of the insulation substrate at one edge, with part or all of the partial-glaze layer being shaped into a trapezoidal configuration, grooves formed in the insulation substrate at the opposite sides of the base of the trapezoidal partial-glaze layer, a resistive film layer formed over the trapezoidal partial-glaze layer, common and discrete electrodes formed on the resistive film layer at the area other than the top of the trapezoidal partial-glaze layer part, thereby providing a heating section on the top of the trapezoidal partial-glaze layer part, and a protective film layer formed over the heating sect:ton and common and discrete electrodes.

The grooves around the base of the trapezoidal partial-glaze layer are provided because the advantage obtained by upwardly extending the trapezoidal partial-glaze layer becomes more notable. The grooves may take various configurations, for example, a first configuration that receives the resistive film, electrodes and protective film, thereby apparently causing the trapezoidal partial-glaze layer to extend further upwards relative to the other layer area surrounding it; a second configuration that is formed around the base of the trapezoidal partial-glaze layer to have the side wall of the groove substantially coincident with the outline of the base of the trapezoidal partial-glaze layer, thereby apparently extending the outline of the trapezoidal partial-glaze layer base; and a third configuration that is formed around the base of the trapezoidal partial-glaze layer to have a depth ranged between 10 microns and 300 microns and a width ranged between 0.1 mm and 10 mm if the trapezoidal partial-glaze layer has a height ranged between 10 microns and 70 microns and a width ranged between 300 microns and 1000 microns. All these groove configurations function equally well. It is to be understood that the present invention may include any other groove configurations if they can provide the advantage that the trapezoidal partial-glaze layer is apparently extended further upwards from the substrate.

In such an arrangement, the top of the trapezoidal partial-glaze layer includes the heating section formed therein and the resistive film layer, common and discrete electrodes and protective film layer are embedded in the grooves of the insulation substrate. Thus, the heating section on the top of the trapezoidal partial-glaze layer part will extend further outwards from the remaining head portions. Unnecessary dispersion of pressure to the head portions other than the heating section can be avoided. As a result, necessary pressure can be concentrated only onto the heating section to improve the printing efficiency. This also improves the transmission of heat to the ink ribbon and other parts such that any unnecessary heat accumulation can be avoided. This speeds up the printing.

The present invention further provides a thermal head comprising an insulation substrate, an upwardly convex partial-glaze layer formed on the top of the insulation substrate at one edge, a groove formed in the insulation substrate on the side of the upwardly convex partial-glaze layer adjacent to the center of the insulation substrate, a resistive film layer formed over the upwardly convex partial-glaze layer and groove, common and discrete electrodes formed on the opposite sides of the resistive film layer about the partial-glaze layer to provide a heating section on the top of the resistive film layer, and a protective film layer formed to cover the heating section and common and discrete electrodes.

The groove is provided so that the upwardly convex partial-glaze layer is apparently extended further upwards from the insulation substrate. The groove may take various configurations, for example, a first configuration that receives the resistive film, electrodes and protective film, thereby apparently causing the upwardly convex partial-glaze layer to extend more upwardly relative to the other layer area surrounding it; a second configuration that is formed along the base of the upwardly convex partial-glaze layer to have the side wall of the groove substantially coincident with the outline of the base of the partial-glaze layer, thereby apparently causing the upwardly convex partial-glaze layer to extend more upwardly from the insulation substrate; and a third configuration that is formed around the base of the trapezoidal partial-glaze layer to have a depth ranged between 10 microns and 300 microns and a width ranged between 0.1 mm and 10 mm If the upwardly convex partial-glaze layer has a height ranged between 10 microns and 70 microns and a width ranged between 300 microns and 1000 microns. All the grooves having these configurations function equally well. It is to be understood that the present invention may include all other groove configurations if they can provide the advantage that the trapezoidal partial-glaze layer is apparently extended further upwards from the substrate.

In such an arrangement, since the resistive film layer and part of the discrete electrode are embedded in the groove, the heating section on the top of the resistive film layer will extend further outwards from the remaining head portions. Unnecessary dispersion of pressure to the head portions other than the heating section can be avoided. As a result, necessary pressure can be concentrated only onto the heating section to improve the printing efficiency. This also improves the transmission of heat to the ink ribbon and other parts such that any unnecessary heat accumulation can be avoided. This speeds up the printing. Since the heating section is formed on the top of the partial-glaze layer covered with the resistive film layer at the edge of the substrate, furthermore, a plurality of thermal heads can be simultaneously formed in the same insulation substrate through the half-cutting process (non-through cutting process) with a reduction of the manufacturing cost for each thermal head.

The present invention further provides a process of making thermal heads, comprising the steps of forming an upwardly convex partial-glaze layer in the top of an insulation substrate at one edge; cutting that portion of the insulation substrate adjacent to the base of the upwardly convex partial-glaze layer, such as by a laser, to form a trapezoidal groove; rounding the corners of the trapezoidal groove by re-heating (or re-burning) or by chemical hydrofluoric acid treatment; forming common and discrete electrodes on the glaze layer; and forming a protective film layer to cover the heating section (on the top of the resistive film layer) and common and discrete electrodes.

This process can easily mass-produce thermal heads each having a groove formed along the base portion of the partial-glaze layer adjacent to the center of the insulation substrate.

More particularly, after an upwardly convex partial-glazelayer has been formed on the top of an insulation substrate at one edge, the insulation substrate is cut to form a trapezoidal groove at a position opposite to the base portion of the upwardly convex partial-glaze layer adjacent to the center of the insulation substrate. When the corners of the trapezoidal groove are rounded, the subsequent patterning process can be facilitated. Thereafter, a resistive film layer and common and discrete electrodes are formed on the glaze layer. Thus, the resistive film layer and part of the discrete electrode will be embedded in the groove. Finally, a protective film layer is formed to cover the heating section and common and discrete electrodes. In such a manner, the heating section will apparently extend further upwards from the surrounding area, such that the heating section can be subject to a sufficient concentration of pressure. By the use of tile half-cutting process (non-through cutting process) and the rounding step, a plurality of thermal heads can be simultaneously produced in the same insulation substrate with a reduction of the manufacturing cost for each thermal head.

The present Invention further provides a thermal head comprising an insulation substrate, an upwardly convex partial-glaze layer formed on the top of the insulation substrate at one edge so as to have a slope steeper than the other slope, a resistive film layer formed on the partial-glaze layer, common and discrete electrodes formed on the resistive film layer at the opposite sides of the base of the partial-glaze layer to provide a heating section on the top of the resistive film layer, and a protective film layer formed to cover the heating section and common and discrete electrodes.

In such a thermal head, the steeper slope of the upwardly convex partial-glaze layer is located at a position adjacent to the center of the insulation substrate and formed by glaze etching. Thus, the heating section on the top of the resistive film layer will extend further outwards from the remaining head portions. Unnecessary dispersion of pressure to the head portions other than the heating section can be avoided. As a result, necessary pressure can be concentrated only onto the heating section to improve the printing efficiency. This also improves the transmission of heat to the ink ribbon and other parts such that any unnecessary heat accumulation can be avoided. This speeds up the printing. Since the heating section is formed on the top of the partial-glaze layer covered with the resistive film layer at the edge of the substrate, furthermore, a plurality of thermal heads can be simultaneously formed in the same insulation substrate through the half-cutting process (non-through cutting process) with a reduction of the manufacturing cost for each thermal head.

The present invention further provides a process of producing thermal heads, comprising the steps of forming an upwardly convex partial-glaze layer on the top of an insulation substrate at one edge; cutting the upwardly convex partial-glaze layer by, for instance, glaze etching to form a slope steeper than the other slope therein; rounding the cut corners of the upwardly convex partial-glaze layer by re-heating (or re-burning) or by chemical hydrofluoric acid treatment; forming common and discrete electrodes on the glaze layer; and forming a protective film layer to cover a heating section and the common and discrete electrodes.

This process can easily mass-produce thermal heads each having one slope steeper than the other.

More particularly, after the upwardly convex partial-glaze layer has been formed on the top of the insulation substrate at one edge, it is cut by for example, glaze etching, to form one slope of the upwardly convex partial-glaze layer steeper than the other. The cut slope of the upwardly convex partial-glaze layer is then rounded by a re-heating (or re-burning) step or by chemical hydrofluoric acid treatment. As a result, the subsequent patterning can be facilitated. Thereafter, the partial-glaze layer is covered with the resistive film layer and common and discrete electrodes such that the resistive film layer and part of the discrete electrode will be coincident with the steeper slope of the partial-glaze layer. Thus, the heating section will apparently extend further upwards from the surrounding area and be subject to a sufficient concentration of pressure. By the use of the half-cutting process (non-through cutting process) and the rounding step, a plurality of thermal heads can be simultaneously produced in the same insulation substrate with a reduction of the manufacturing cost for each thermal head.

If the volume of the partial-glaze layer is reduced, its heat capacity is also reduced to cool the heating section more rapidly, leading to a reduction of the energy efficiency. However, the thermal responsiveness will be increased because the heating section can be set at higher temperatures since the heating section can be more rapidly cooled from these higher temperatures. The increase of the thermal responsibility speeds up the printing. If the width of the partial-glaze layer is suitably regulated, the high-speed printing can be carried out while maintaining the thermal head at a higher temperature. However, if the width of the partial-glaze layer is too small, the partial-glaze layer itself cannot function significantly. It is therefore important that the width and height of the partial-glaze layer are appropriately selected for the desired purpose. It has been found that the thermal head of the present invention could accomplish the desired purpose if the partial-glaze layer had a width ranged between 300 microns and 1000 microns and preferably equal to about 550 microns and a height ranged between 10 microns and 70 microns and preferably equal to about 55 microns. The aforementioned features of the thermal head may be attained in various combinations with each other, which are within the scope of the invention as defined in the attendant claims.

When the thermal head of the present invention including its heating resistor section subject to a sufficient concentration of pressure is incorporated into an electronic printing instrument such as a printer or the like, the instrument can print more clearly and quickly. Since a pattern of ink can be reliably separated from an ink ribbon through the increased concentration of pressure at the heating resistor section of the thermal head, the printing can be appropriately made even for rough sheets. Since the thermal heads of the present invention can be mass-produced inexpensively, electronic instruments such as printers Incorporating the thermal heads of the present invention can be also produced correspondingly cheaply.

DETAILED DESCRIPTION OF THE PREFERRED EMBODIMENTS

Figure 6:
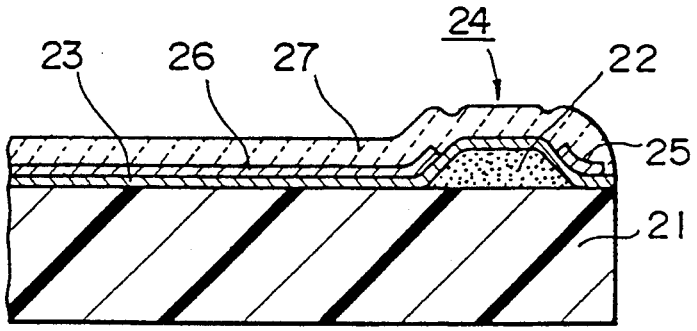
FIG. 6 is a cross-sectional view of the major part of a thermal head which is a first embodiment of the present invention.

Referring first to FIG. 6, there is shown the first embodiment of a thermal head constructed in accordance with the present invention, which comprises an insulation substrate 21, a trapezoidal partial-glaze layer 22 formed on the insulation substrate 21 at one edge, a resistive film layer 23 formed on the partial-glaze layer 22, and common and discrete electrodes 25, 26 formed on the resistive film layer 23 at opposite sides of the partial-glaze layer 23. When the resistive film layer 23 and common and discrete electrodes 25, 26 are covered with a protective film layer 27, a heating section 24 is provided at a position corresponding to the top of the trapezoidal partial-glaze layer 22. The protective film layer 27 is usually made of a material which can prevent abrasion and oxidation in the resistive film layer 23 and electrodes of the thermal head. Alternatively, the protective film layer 27 may be made as a lamination which is formed from materials capable of preventing abrasion and oxidation, respectively.

The thermal head of the first embodiment is characterized by the fact that the entire configuration of the partial-glaze layer 22 is trapezoidal and that the common and discrete electrodes 25, 26 are disposed on the opposite base sides of the trapezoidal partial-glaze layer 22. Therefore, the top of the trapezoidal partial-glaze layer 22 is clear of the common and discrete electrodes 25, 26 to provide the heating section 24 thereof. As a result, the heating section 24 will extend further upwards from the surrounding area. When pressure is applied to the thermal head of tile first embodiment, the pressure will concentrate on the heating section 24.

The trapezoidal partial-glaze layer 22 may be formed by first forming an upwardly convex partial-glaze layer as in the prior art and then cutting the upwardly convex partial-glaze layer at the opposite sides (adjacent to the edge and center of the substrate 21), which will be described in detail later.

Figure 1:
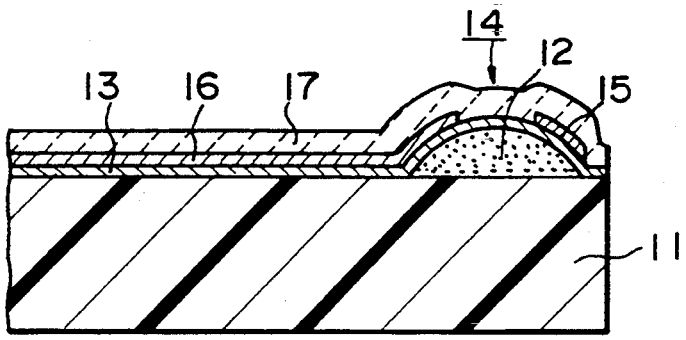
FIG. 1 PRIOR ART
FIG. 1 is a partial cross-section of a thermal head constructed in accordance with the prior art.
Figure 2:
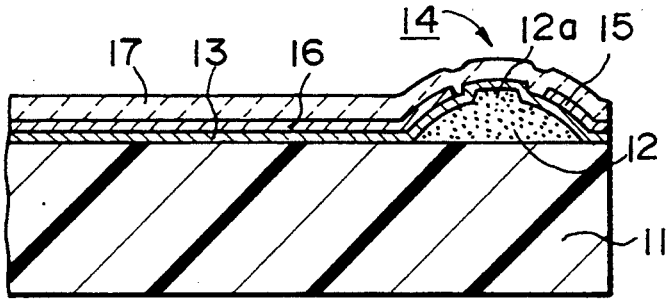
FIG. 2 PRIOR ART
FIG. 2 is a partial cross-section of another thermal head constructed in accordance with the prior art.
Figure 3:
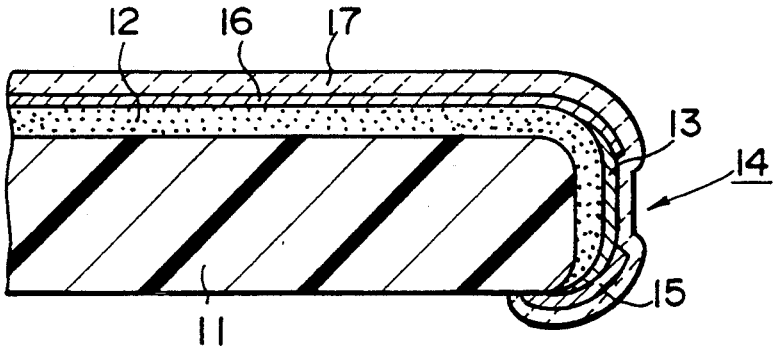
FIG. 3 PRIOR ART
FIG. 3 is a partial cross-section of still another thermal head constructed in accordance with the prior art.
Figure 4:
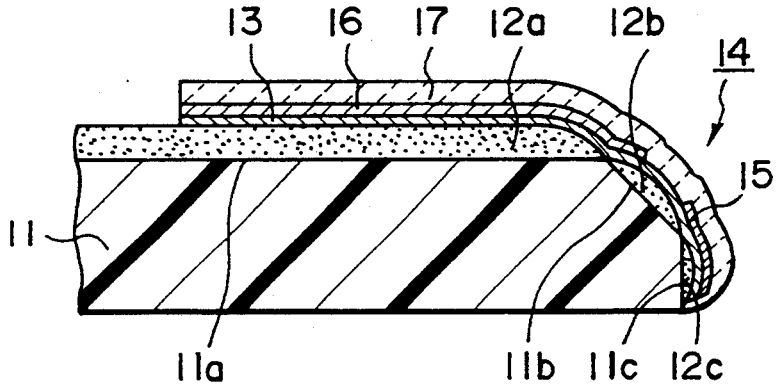
FIG. 4 PRIOR ART
FIG. 4 is a partial cross-section of a further thermal head constructed in accordance with the prior art.
Figure 5:
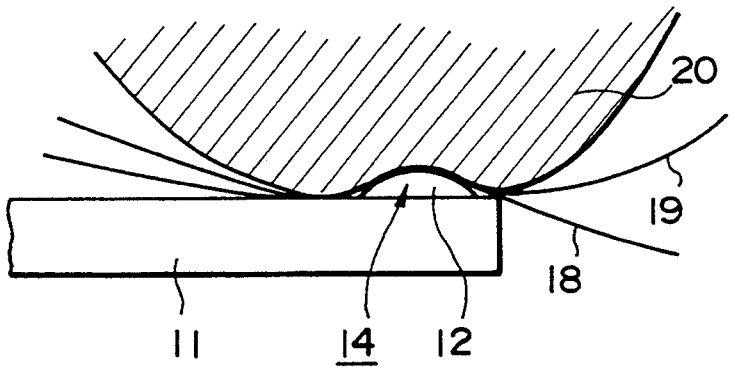
FIG. 5 PRIOR ART
FIG. 5 illustrates the disadvantage of the prior art.
Figure 7:
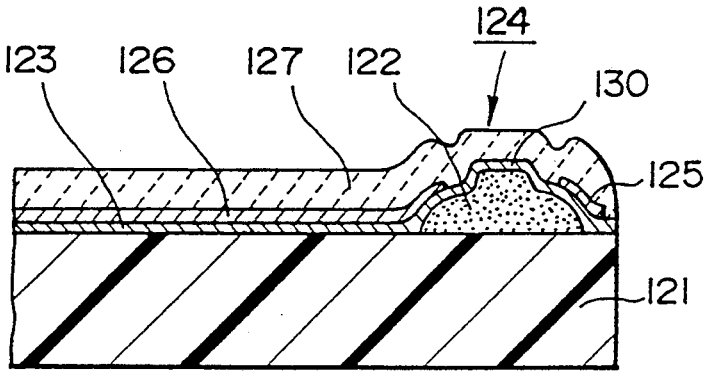
FIG. 7 is a cross-sectional view of the major part of a thermal head which is a second embodiment of the present invention.

Referring next to FIG. 7, there is shown the second embodiment of a thermal head constructed in accordance with the present invention, in which parts similar to those of the first embodiment are denoted by similar reference numerals plus one hundred and will not be further described. In the second embodiment, a thermal head comprises an upwardly convex partial-glaze layer 122 including a trapezoidal top portion 130. Common and discrete electrodes 125,126 are formed on the curved side wall of the upwardly convex partial-glaze layer 122 at the opposite sides thereof so as not to cover the trapezoidal top portion 130. Thus, the trapezoidal top portion 130 can entirely function as the heating section 124. When pressure is exerted onto the thermal head of the second embodiment, it is sufficiently concentrated on the heating section 124. The trapezoidal partial-glaze layer 122 having the trapezoidal top portion 130 may be formed by laser cutting, as in the first embodiment. The common and discrete electrodes 25, 26 may be easily formed by the conventional patterning process. It is preferred that the height of the trapezoidal top portion is ranged between 5 microns and 50 microns. If the height of the trapezoidal top portion is equal to or larger than 5 microns, the pressure on the head will be sufficiently increased. This advantage will be apparent when one considers the double partial-glaze layer (FIG. 2) of the prior art in which the height was always suppressed to less than 5 microns by etching. The advantage of the present invention having the minimum height (5 microns) at the trapezoidal top portion can be more easily understood when it is compared with the partial-glaze portion of the prior art having the maximum height of 5 microns. Since the height of the trapezoidal top portion is equal to or smaller than 50 microns in the present invention, the "trapezoidal projection" will not be broken by any external force.

Figure 8:
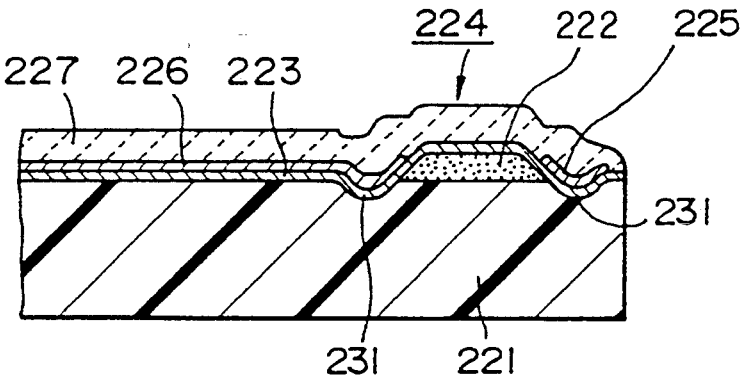
FIG. 8 is a cross-sectional view of the major part of a thermal head which is a third embodiment of the present invention.

FIG. 8 shows the third embodiment of a thermal head constructed in accordance with the present invention, in which parts similar to those of the first embodiment shown in FIG. 6 are designated by similar reference numerals plus two hundred and will not be further described.

In the third embodiment, grooves 231 are formed in an insulation substrate 221 on the opposite sides of the trapezoidal partial-glaze layer 22 (adjacent to the edge and center of the substrate 221). A resistive film layer 223 is then formed to cover the insulation substrate 221, grooves 231 and trapezoidal partial-glaze layer 22. Common and discrete electrodes 225, 226 are disposed to extend from the insulation substrate 221 to the opposite sides of the trapezoidal partial-glaze layer 22, but not to cover the top of the trapezoidal partial-glaze layer 22. As a result, a heating section 224 is provided at the top of the trapezoidal partial-glaze layer 22. The resistive film layer 223 as well as part of each of the common and discrete electrodes 225,226 are embedded in the grooves 231. Correspondingly, the trapezoidal partial-glaze layer 222 will extend further upwards from the insulation substrate 221 than the protective film layer 227 immediately over the grooves 231. When pressure is applied to the thermal head of the third embodiment, the pressure will be concentrated on the heating section 224 more than in the thermal head of the first embodiment. If it is desired to obtain the same concentration of pressure as in the first embodiment, the thermal head of the third embodiment can have a trapezoidal partial-glaze layer having a thickness smaller than that of the first embodiment.

The grooves 231 may take various configurations, for example, a first configuration that receives the resistive film, electrodes and protective film, thereby apparently causing the trapezoidal partial-glaze layer to extend further upwards relative to the other layer area surrounding it; a second configuration that is formed around the base of the trapezoidal partial-glaze layer to have the side wall of the groove substantially coincident with the outline of tile base of the trapezoidal partial-glaze layer, thereby apparently extending the outline of the trapezoidal partial-glaze layer base; and a third configuration that is formed around the base of the trapezoidal partial-glaze layer to have a depth ranged between 10 microns and 300 microns and a width ranged between 0.1 mm and 10 mm if the trapezoidal partial-glaze layer has a height ranged between 10 microns and 70 microns and a width ranged between 300 microns and 1000 microns. All the grooves having these configurations function equally well. It is to be understood that the present invention may include any other configurations of groove if they can provide the advantage that the trapezoidal partial-glaze layer is apparently extended further upwards from the substrate.

The partial-glaze layer 22 of partially trapezoidal configuration and grooves 231 may be formed by laser cutting or the like, as in the first embodiment.

Figure 9:
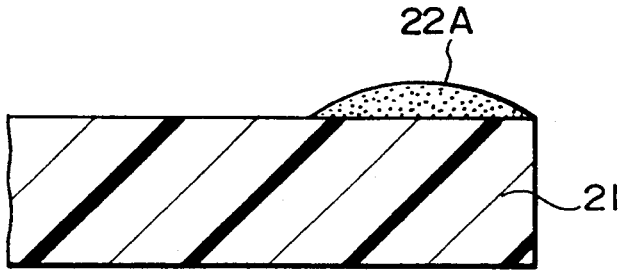
FIG. 9 illustrates a process of making the thermal head of the first embodiment of the present invention, in which a glaze layer is formed on a substrate.
Figure 10:
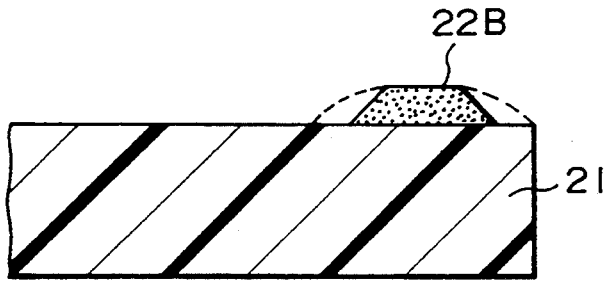
FIG. 10 illustrates the glaze layer formed into a trapezoidal configuration.
Figure 11:
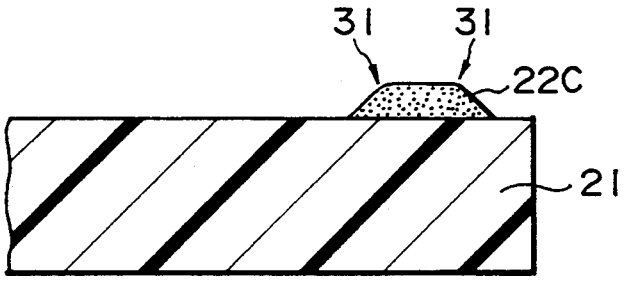
FIG. 11 illustrates the trapezoidal glaze layer having rounded corners.

FIGS. 9–11 illustrate a process of making the thermal head of the first embodiment.

In the process, an upwardly convex partial-glaze layer 22A is first formed on the top of an Insulation substrate 21 (FIG. 9). As shown in FIG. 10, the upwardly convex partial-glaze layer 22A is then cut at the opposite sides thereof (adjacent to the edge and center of the substrate 21) by, for example, laser cutting, to form a trapezoidal partial-glaze layer 22B. If the trapezoidal partial-glaze layer 22A has a sufficiently large width, the top thereof is apparently flat. Therefore, the trapezoidal partial-glaze layer 22B can be formed only by cutting the opposite sides of the upwardly convex partial-glaze layer 22A without cutting the top thereof. As shown in FIG. 11, the sharp corners 31 of the trapezoidal partial-glaze layer 22B are rounded by re-heating (or re-burning) or chemical fluorite treatment. This facilitates the subsequent patterning step. A resistive film layer 23 is then formed to cover the rounded trapezoidal partial-glaze layer 22C and insulation substrate 21. Common and discrete electrodes 25, 26 are then formed at the opposite sides of the trapezoidal partial-glaze layer 22C such that the top of the trapezoidal partial-glaze layer 22C covered with the resistive film layer 23 is clear of these electrodes. Thereafter, a protective film layer is formed to cover the resistive film layer 23 and common and discrete electrodes 25, 26. In such a manner, a heating section will be provided on the top of the trapezoidal partial-glaze layer 22C which is not covered with the common and discrete electrodes 25, 26, that is, which is covered only with the resistive film layer 23 (see FIG. 6).

In accordance with the process of the present invention, thermal heads each having a heating section 24 which extends further upwards from the surrounding area and is subject to a sufficient concentration of pressure can be easily mass-produced. By the use of the half-cutting process (non-through cutting process) and the rounding step, a plurality of thermal heads can be simultaneously produced in the same insulation substrate with a reduction of the manufacturing cost for each thermal head.

The thermal heads of tile second and third embodiments may be produced in the same manner as in the first embodiment.

Since the second and third embodiments provide a trapezoidal partial-glaze layer providing a heating section which extends further upwards from the surrounding area, the heating section will be subject to a sufficient concentration of pressure. This increases the transmission of heat from the heating section to the ink ribbon and other parts to improve the printing efficiency and to speed up the printing operation. The increased pressure on the heating section enables any rough sheet to be thermally printed with more efficiency. The trapezoidal partial-glaze layer may easily substitute for the conventional thermal heads without any modification. In the process of the present invention, the patterning may be more easily made by cutting and rounding the trapezoidal partial-glaze layer with stability in shape. By performing the half-cutting and rounding steps, a plurality of thermal heads may be simultaneously formed in the same insulation substrate with a reduction of the manufacturing cost.

Figure 12:
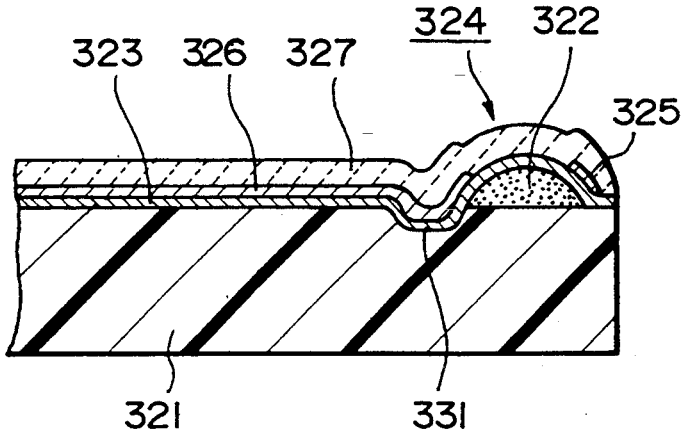
FIG. 12 is a cross-sectional view of the major part of a thermal head which is a fourth of the present invention.

FIG. 12 shows the fourth embodiment of a thermal head constructed in accordance with the present invention, in which parts similar to those of the first embodiment are denoted by similar reference numerals plus three hundred and will not be further described.

The thermal head of the fourth embodiment comprises an insulation substrate 321, a partial-glaze layer 322 formed on the insulation substrate 321 at one edge, a groove 331 formed in the insulation substrate 321 at an inner position adjacent to part of the base of the partial-glaze layer 322, and a resistive film layer 323 formed to cover the insulation substrate 321 and partial-glaze layer 322. Common and discrete electrodes 325, 326 are formed on the resistive film layer 323 at the opposite sides of the partial-glaze layer 322. A protective film layer 327 is formed to cover the resistive film layer 323 and common and discrete electrodes 325, 326. When the common and discrete electrodes 325,326 are energized, that portion of the resistive film layer 323 not covered by the common and discrete electrodes 325, 326 is heated to provide a heating section 324 on the top of the partial-glaze layer 322.

The thermal head of the fourth embodiment is characterized by the fact that the resistive film layer 323 and part of the discrete electrode 326 thereon are embedded within the groove 331. In the fourth embodiment, the partial-glaze layer 322 is of an upwardly convex configuration. The groove 331 is of a trapezoidal configuration which is formed in the substrate 321 on the side of the partial-glaze layer 322 adjacent to the center of the insulation substrate 321, that is, opposite to the edge thereof. Since the groove receives the resistive film layer 323 and part of the discrete electrode 326, the heating section 324 on the top of the partial-glaze layer 322 will extend further upwards relative to the bottom of the groove, that is, the plane of the insulation substrate 321. The groove 331 may be formed as by laser cutting. The top of the partial-glaze layer 322 is not necessarily formed into an upwardly convex curvature, but may be similar to those of the first and second embodiments. If the partial-glaze layer 322 is entirely formed into a trapezoidal configuration as in the first embodiment, it provides the same advantage when one of two grooves 231 on the central side of the insulation substrate is omitted.

The groove 331 in the fourth embodiment is provided for the same purpose as the grooves 231 in the third embodiment. Therefore, the groove 331 may take various configurations, for example, a first configuration that receives the resistive film, electrodes and protective film, thereby apparently causing the upwardly convex partial-glaze layer to extend more upwardly relative to the other layer area surrounding it; a second configuration that is formed along the base of the upwardly convex partial-glaze layer to have the side wall of the groove substantially coincide with the outline of the base of the partial-glaze layer, thereby apparently causing the upwardly convex partial-glaze layer to extend further upwards from the insulation substrate; and a third configuration that is formed around the base of the trapezoidal partial-glaze layer to have a depth ranged between 10 microns and 300 microns and a width ranged between 0.1 mm and 10 mm if the upwardly convex partial-glaze layer has a height ranged between 10 microns and 70 microns and a width ranged between 300 microns and 1000 microns. All the grooves having these configurations function equally well. It is to be understood that the present invention may include all the other configurations of groove if they can provide the advantage that the partial-glaze layer is apparently extended further upwards from the substrate. Although the grooves 231 and 331 in the third and fourth embodiments are shown to be substantially trapezoidal, they may take any possible groove configuration, such as a semi-circular configuration, as long as they satisfy the purpose of the invention that the partial-glaze layer extends further upwards from the surrounding area.

In all tile aforementioned embodiments, it is preferred that the basic angle In the trapezoidal partial-glaze layer is ranged between 20 degrees and 45 degrees. This provides an improved concentration of pressure against the thermal head to improve the printing efficiency.

Figure 13:
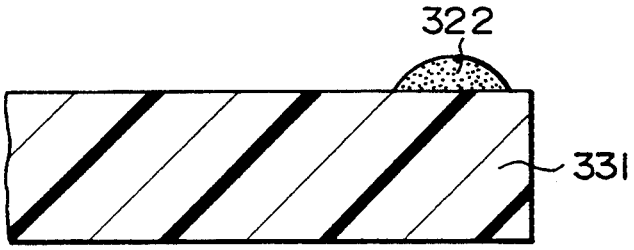
FIG. 13 illustrates a process of making the thermal head of the fourth embodiment of the present invention, in which a glaze layer is formed on a substrate.
Figure 14:
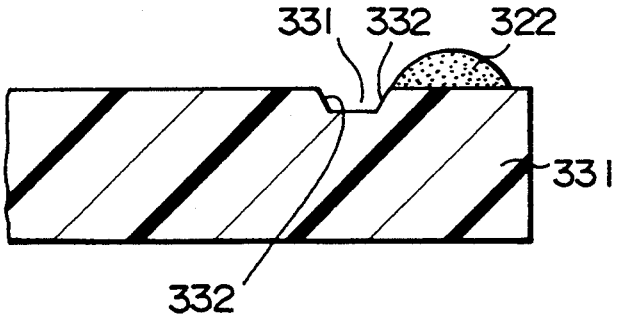
FIG. 14 illustrates the substrate including a groove formed therein.
Figure 15:
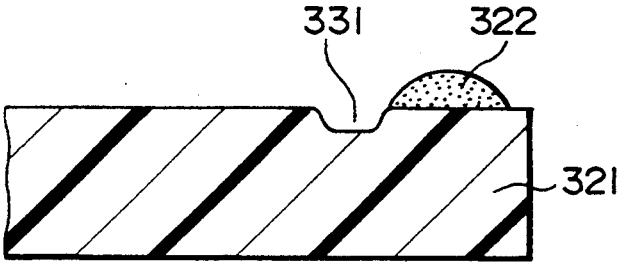
FIG. 15 illustrates the groove having rounded corners.

FIGS. 13–15 illustrate a process of making the thermal head in accordance with the fourth embodiment of the present invention.

The upwardly convex partial-glaze layer 322 is first formed on the top of the insulation substrate 321 at one edge (FIG. 13). The Insulation substrate 321 is cut to form a trapezoidal groove 331 at a position adjacent to the center of the insulation substrate 321 (FIG. 14). As shown in FIG. 15, the corners 332 of the trapezoidal groove 331 are then rounded by re-heating (or re-burning) or chemical fluorite treatment. This facilitates the subsequent patterning step. The resistive film layer 323 is then formed to cover the substrate 321 and partial-glaze layer 322 and the common and discrete electrodes 325, 326 are formed on the resistive film layer 323. In such a manner, the resistive film layer 323 and part of the discrete electrode 326 will be embedded in the groove 331. Thereafter, the protective film layer 327 is formed to cover the resistive film layer 323 and common and discrete electrodes 325, 326 (see FIG. 12). The groove 331 may be formed in the substrate 321 by, for instance, laser cutting.

The process can easily produce the thermal head of the fourth embodiment. By the use of half-cutting (non-through cutting) and rounding steps, a plurality of thermal heads can be simultaneously produced in the same substrate with a reduction of the manufacturing cost.

In the fourth embodiment, the partial-glaze layer will extend further upwards from the surrounding area by forming the groove in the insulation substrate at a position corresponding to part of the base of the partial-glaze layer, with the groove receiving the resistive film layer and part of the discrete electrode. Thus, tile heating section can be subject to a sufficient concentration of pressure to Improve the transmission of heat to the ink ribbon and other parts, thereby increasing the printing efficiency and speed with improvement of the thermal transfer to rough sheets. The thermal head of the fourth embodiment may substitute for the conventional thermal heads without any particular modification. Since the heating section exists at the edge of the substrate, a plurality of thermal heads can be simultaneously produced in the same substrate with a reduction of the manufacturing cost.

Figure 16:
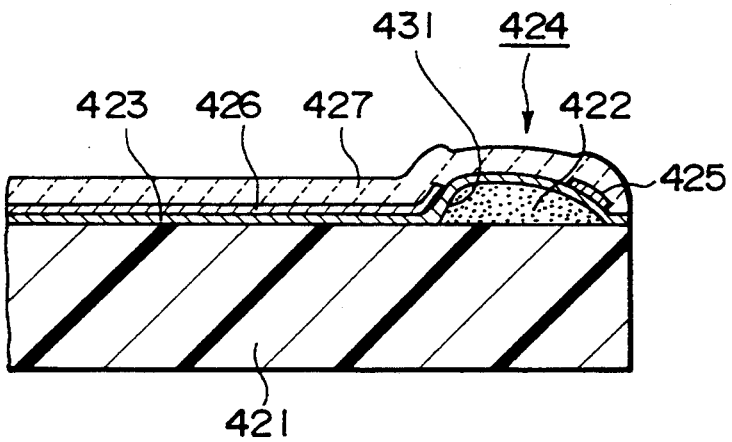
FIG. 16 is a cross-sectional view of the major part of a thermal head which is a fifth embodiment of the present invention.

Referring now to FIG. 16, there is shown the fifth embodiment of a thermal head constructed in accordance with the present invention, which comprises an insulation substrate 421; a partial-glaze layer 422 formed on the top of the insulation substrate 421 at one edge, the partial-glaze layer having one slope steeper than the other slope; a resistive film layer 423 formed on the partial-glaze layer 422, common and discrete electrodes 425,426 formed on the resistive film layer 423 at the opposite sides of the partial-glaze layer 422; and a protective film layer formed to cover the resistive film layer 423 and common and discrete electrodes 425,426. The top of the partial-glaze layer 422 not covered with the common and discrete electrodes 425,426 provides a heating section 424.

The thermal head of the fifth embodiment is characterized by the fact that the partial-glaze layer 422 has one slope 431 steeper than the other slope. The partial-glaze layer 422 is of an upwardly convex curvature configuration in the fifth embodiment. The steeper slope 431 may be formed by cutting that side of the upwardly convex partial-glaze layer 422 adjacent to the center of the substrate 421 or opposite to the edge thereof such as by glaze etching. The resistive film layer 423 and part of the discrete electrode 426 are inclined more steeply in the presence of the steeper slope 431 in the partial-glaze layer 422, so that the heating section 424 apparently extends further upwards from the surrounding area.

Figure 17:
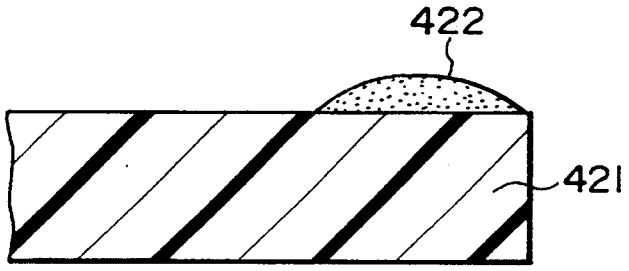
FIG. 17 illustrates a process of making the thermal head of the fifth embodiment of the present invention, in which a glaze layer is formed on a substrate.
Figure 18:
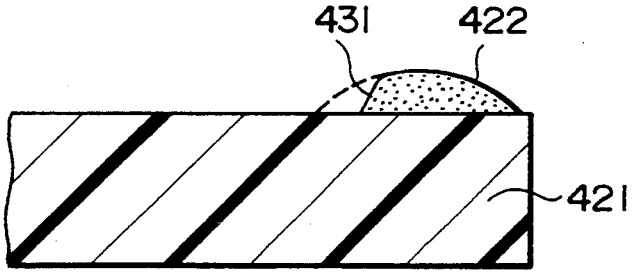
FIG. 18 illustrates a steeper slope formed on the glaze layer.
Figure 19:
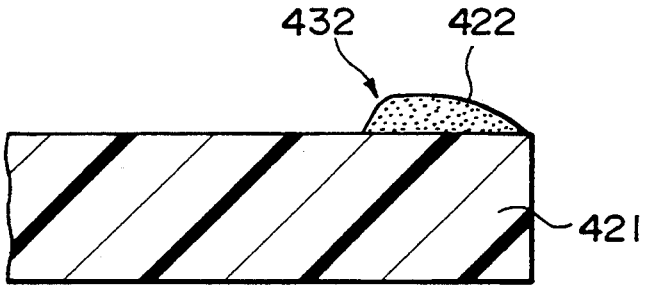
FIG. 19 illustrates the rounding step of the slope.

FIGS. 17–19 illustrate a process of making the thermal head in accordance with the fifth embodiment of the present invention.

In order to produce the thermal head of the fifth embodiment, an upwardly convex curved partial-glaze layer 422 is first formed on the top of the insulation substrate 421 at one edge (FIG. 17). As shown in FIG. 18, the steeper slope 431 is formed by cutting that side of the upwardly convex partial-glaze layer 431 nearer the center of the insulation substrate 421 such as by glaze etching. As shown in FIG. 19, the corner 432 of the cut slope 431 is then rounded by re-heating (or re-burning) or chemical hydrofluoric acid treatment. This facilitates the subsequent patterning step. The partial-glaze layer 422 is covered with the resistive film layer 423 and then the common and discrete electrodes 425,426 are formed on the resistive film layer 423. The resistive film layer 423 and part of the discrete electrode 426 are inclined more steeply in the presence of the steeper slope 431 in the partial-glaze layer 422. The protective film layer 427 is finally formed to cover the resistive film layer 423 and common and discrete electrodes 425,426 (see FIG. 16). In such a manner, the heating section 424 will be provided on the top of the partial-glaze layer 422 which extends further upwards from the surrounding area.

The process can easily produce the thermal head of the fifth embodiment. By the use of half-cutting (non-through cutting) and rounding steps, a plurality of thermal heads can be simultaneously produced in the same substrate with a reduction of the manufacturing cost.

In the fifth embodiment, since the partial-glaze layer has one slope steeper than the other slope, it will apparently extend further upwards from the surrounding area. Thus, the heating section can be subject to a sufficient concentration of pressure to improve the transmission of heat to the ink ribbon and other parts, thereby increasing the printing efficiency and speed with improvement of the thermal transfer to rough sheets. The thermal head of the fifth embodiment may substitute for the conventional thermal heads without any particular modification. Since the heating section exists at the edge of the substrate, a plurality of thermal heads can be simultaneously produced in the same substrate with a reduction of the manufacturing cost.

If the volume of the partial-glaze layer is reduced, its heat capacity is also reduced to cool the heating section more rapidly, leading to a reduction of the energy efficiency. However, the thermal responsiveness will be increased because the heating section can be set at higher temperatures since the heating section can be more rapidly cooled from these higher temperatures. The increase of the thermal responsiveness speeds up the printing operation. If the width of the partial-glaze layer is suitably regulated, the high-speed printing can be carried out while maintaining the thermal head at a higher temperature. However, if the width of the partial-glaze layer is too small, the partial-glaze layer itself cannot function significantly. It is therefore an important point that the width and height of the partial-glaze layer are appropriately selected for the desired purpose. It has been found that the thermal head of the present invention can accomplish the desired purpose if the partial-glaze layer had a width ranged between 300 microns and 1000 microns and preferably equal to about 550 microns and a height ranged between 10 microns and 70 microns and preferably equal to about 55 microns. The aforementioned features of the thermal head may be attained in various combinations with each other, which are within the scope of the invention as defined in the attendant claims.

The thermal heads of the previously described embodiments may be used in various combinations which include all possible combinations easily taken by a person skilled in the art.

In any event, each of the thermal heads according to the previously described embodiments has a heating section which can be subject to a sufficient concentration of pressure to improve the transmission of heat to the ink ribbon and other parts, thereby increasing the printing efficiency and speed with improvement of the thermal transfer to rough sheets. The thermal head of the fourth embodiment may substitute for the conventional thermal heads without any particular modification. Since the heating section exists at the edge of the substrate, a plurality of thermal heads can be simultaneously produced in the same substrate with a reduction of the manufacturing cost.

All the thermal heads of the previously described embodiments may be incorporated into various electronic equipments such as printers, word processors, facsimile machines, plotters and so on.

Figure 20:
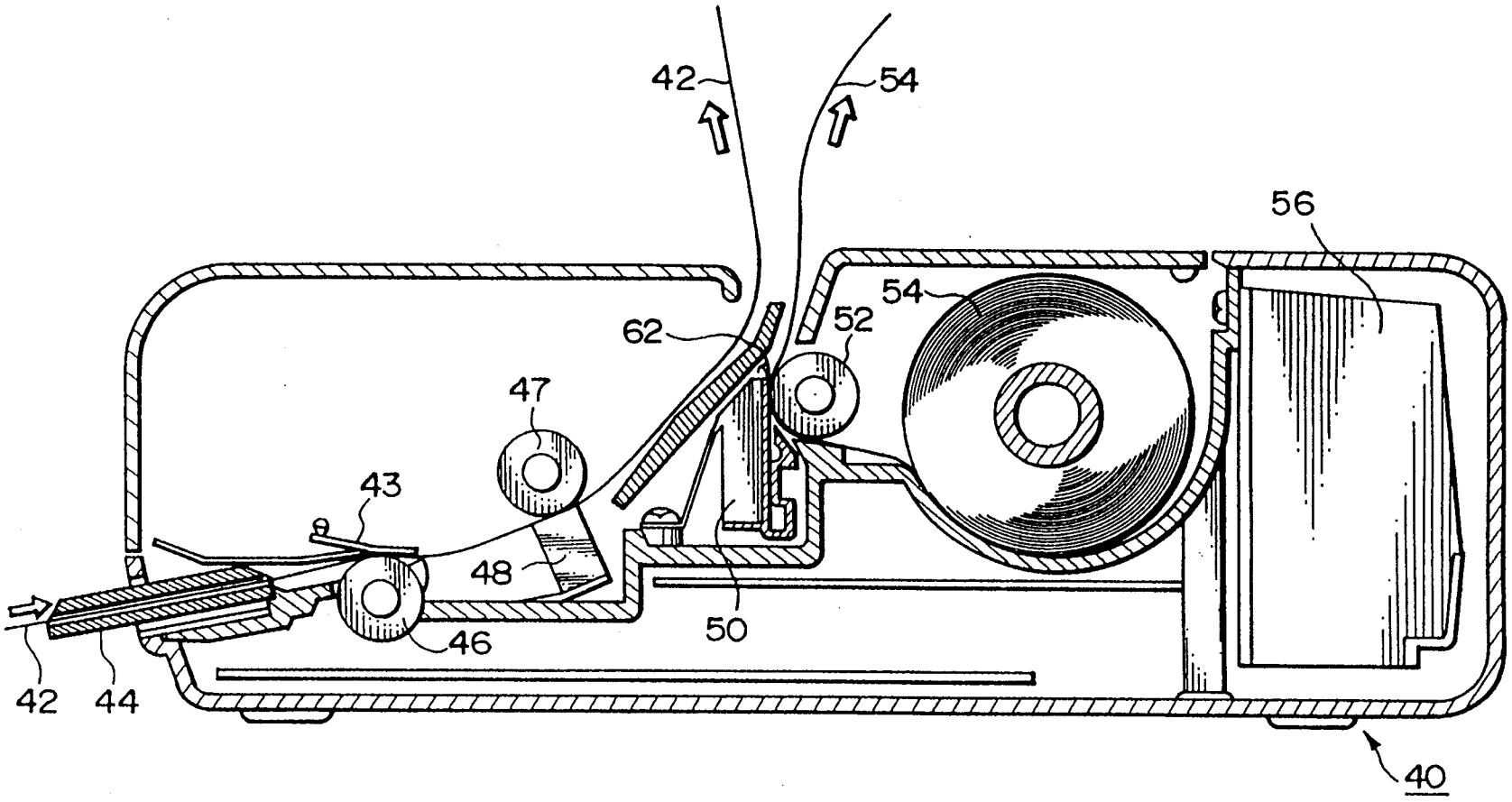
FIG. 20 is a cross-sectional view of the major part of an electronic instrument (printer) into which a preferred thermal head constructed in accordance with the present invention is incorporated.

FIG. 20 shows a printer incorporating a thermal head which is constructed in accordance with the present invention. The printer 40 comprises an inlet 44 into which an original 42 is to be inserted, a feed roller 46 for feeding the original 42, an image sensor 48 for reading the original 42, a printing section 50 for printing onto a recording sheet 54 and a recording platen roller 52 located adjacent to the printing section 50. The printer 40 is powered by a source of electric power 56. When a plurality of originals 42 are inserted into the printer 40 through the inlet 44, the originals 42 will be separated by separating means 43 and then transferred to the image sensor 48 one at a time. The pattern on the original 42 is converted into electrical signals by the image sensor 48. These electrical signals are used to cause the printing section 50 to print onto the recording sheet 54.

Figure 21:
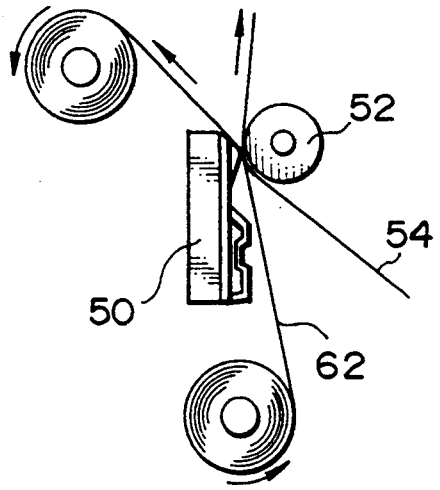
FIG. 21 is a schematic diagram of the major part of the electronic instrument shown in FIG. 20.

As shown in FIG. 21, an ink ribbon 62 is used to enable the printing for rough sheets in the printer 40. FIG. 20 shows a reading mechanism for a copying or facsimile machine. However, the thermal head of the present invention may be used in a printer having no reading mechanism. The thermal head of the present invention may be also used in a serial printer in which a thermal head 64 moves on a flat plate-like platen plate 79 with a ribbon cassette 77 used therein.

Since the thermal head of the present invention has a heating section subject to a sufficient concentration of pressure to improve the transmission of heat to the ink ribbon and other parts to increase the printing efficiency and speed, the printer incorporating the thermal head of the present invention can perform the printing at a speed higher than the prior art.

The increased concentration of pressure against the heating section can more effectively cut letter patterns away from the ink ribbon and transfer the cut letter pattern to a recording sheet. The thermal transfer can be more effectively carried out for rough sheets. In order to improve the thermal transfer for rough sheets, it is required that the ink in the ink ribbon has an increased viscosity and that the letter pattern is thermally cut away from the ink ribbon and applied to the recording sheet under the pressure from the thermal head. If the pressure from the thermal head is too low, the cut letter pattern may not be transferred to the recording sheet or may be returned to the ink ribbon after the letter pattern has been temporarily transferred to the recording sheet. The thermal head of the present invention can provide a sufficient concentration of pressure against the heating section such that the Just mentioned problem can be overcome to perform thermal transfer to the rough sheets more efficiently.

Since the thermal head of the present invention has the heating section which can substitute for the conventional heating heads without any particular modification in design, the conventional printers incorporating thermal heads constructed in accordance with the prior art may be easily replaced by the printer incorporating the thermal head of the present invention.

Since the heating section is formed in the substrate at the edge according to the present invention, a plurality of thermal heads can be simultaneously produced in the same substrate more inexpensively. When a printer includes a thermal head constructed in accordance with the present invention, the printer can be inexpensive with an improved performance.

Although the preferred embodiments of the present invention have been described, tile present invention is not limited to such forms and may carried out in various modified or changed forms without departing from the scope of the invention as defined in the appended claims.

We claim:

1. A thermal head comprising:

an insulation substrate having a top surface extending in a first direction of the insulation substrate, a second direction being perpendicular to the top surface;

an at least partially trapezoidal partial-glaze layer formed over the top surface of the insulation substrate, the at least partially trapezoidal partial-glaze layer formed at one edge of the top surface of the insulation substrate;

a resistive film layer formed over at least a top surface of said at least partially trapezoidal partial-glaze layer;

an electrode pattern formed over said resistive film layer, a gap being formed in the electrode pattern over the top surface of said at least partially trapezoidal partial-glaze layer;

a protective film layer formed over said resistive film layer and said electrode pattern, wherein a heating section is formed over the top surface of said at least partially trapezoidal partial-glaze layer; and at least one groove formed in said insulation substrate on a side of said at least partially trapezoidal partial-glaze layer adjacent to a center of said insulation substrate and at a position corresponding to a base of said at least partially trapezoidal partial-glaze layer, said resistive film layer formed over an area of the at least one groove, said electrode pattern formed over the resistive film layer at the area of the at least one groove, and said protective film layer formed over the electrode pattern at the area of the at least one groove.

2. The thermal head of claim 1, wherein said at least partially trapezoidal partial-glaze layer has a width, measured in the first direction, ranging between 300 microns and 1000 microns, and a height, measured in the second direction, ranging between 10 microns and 70 microns, and wherein said at least one groove has a width, measured in the first direction, ranging between 0.1 mm and 10 mm and a depth, measured in the second direction, ranging between 10 microns and 300 microns.

3. A printing apparatus comprising an image sensor outputting electrical signals corresponding to patterns on a document to be printed, means for supplying a sheet of printing paper, means for feeding an ink ribbon, and a thermal head responsive to the electrical signals to heat said ink ribbon and to print said patterns on the sheet of printing paper, said thermal head comprising:

an at least partially trapezoidal partial-glaze layer formed over a top surface of an insulation substrate, the at least partially trapezoidal partial-glaze layer formed at one edge of the top surface of the insulation substrate;

a resistive film layer formed over at least a top surface of said at least partially trapezoidal partial-glaze layer;

an electrode pattern formed over said resistive film layer, a gap being formed in the electrode pattern over the top surface of the at least partially trapezoidal partial-glaze layer;

a protective film layer formed over said resistive film layer and said electrode pattern; and at least one groove formed in said insulation substrate on a side of said at least partially trapezoidal partial-glaze layer adjacent to a center of said insulation substrate and at a position corresponding to a base of said at least partially trapezoidal partial-glaze layer, wherein said resistive film layer is formed over an area of the at least one groove, said electrode pattern is formed over the resistive film layer at the area of the at least one groove, and said protective film layer is formed over the electrode pattern at the area of the at least one groove, a heating section being formed over the top surface of said at least partially trapezoidal partial-glaze layer.

4. A thermal head comprising:

an insulation substrate having a top surface extending in a first direction of the insulation substrate, a second direction being perpendicular to the top surface;

an upwardly convex curved partial-glaze layer formed on the top surface of the insulation substrate, the upwardly convex curved partial-glaze layer formed at one edge of the top surface of the insulation substrate;

a groove formed in said insulation substrate on a side of said upwardly convex curved partial-glaze layer adjacent to a center of said insulation substrate and at a position corresponding to a base of said upwardly convex curved partial-glaze layer;

a resistive film layer formed over at least a top surface of said upwardly convex curved partial-glaze layer and said groove;

an electrode pattern formed over said resistive film layer, a gap being formed in said electrode pattern over the top surface of the upwardly convex curved partial-glaze layer, wherein a heating section is formed over the top surface of said upwardly convex curved partial-glaze layer; and a protective film layer formed over said resistive film layer and said electrode pattern, wherein said resistive film layer is formed over an area of the groove, said electrode pattern is formed over the resistive film layer at the area of the groove, and said protective film layer is formed over the electrode pattern at the area of the groove.

5. The thermal head of claim 4, wherein said upwardly convex curved partial-glaze layer is at least partially formed into a trapezoidal configuration.

6. The thermal head of claim 5, wherein a part of said upwardly convex curved partial-glaze layer is formed into a trapezoidal configuration, said part having a height ranging between 5 microns and 50 microns.

7. The thermal head of claim 4, wherein said upwardly convex curved partial-glaze layer has a width, measured in the first direction, ranging between 300 microns and 1000 microns and a height, measured in the second direction, ranging between 10 microns and 70 microns, wherein said groove has a width, measured in the first direction, ranging between 0.1 mm and 10 mm and a depth, measured in the second direction, ranging between 10 microns and 300 microns.

8. The thermal head of claim 10, wherein said upwardly convex curved partial-glaze layer has a width, measured in the first direction, equal to about 550 microns and a height, measured in the second direction, equal to about 55 microns and wherein said groove has a width, measured in the first direction, ranging between 0.1 mm and 10 mm and a depth, measured in the second direction, ranging between 10 microns and 300 microns.

9. A printing apparatus comprising an image sensor outputting electrical signals corresponding to patterns on a document to be printed, means for supplying a sheet of printing paper, means for feeding an ink ribbon, and a thermal head responsive to the electrical signals to heat said ink ribbon and to print said patterns on the sheet of printing paper, said thermal head comprising:

an upwardly convex curved partial-glaze layer formed on a top surface of an insulation substrate, the upwardly convex curved partial-glaze layer formed at one edge of the top surface of the insulation substrate;

a groove formed in said insulation substrate on a side of said upwardly convex curved partial-glaze layer adjacent to a center of said insulation substrate and at a position corresponding to a base of said upwardly convex curved partial-glaze layer;

a resistive film layer formed over at least a top surface of said upwardly convex curved partial-glaze layer and said groove;

an electrode pattern formed over said resistive film layer, a gap being formed in the electrode pattern over the top surface of said upwardly convex curved partial-glaze layer, wherein a heating section is formed over the top surface of said upwardly convex curved partial-glaze layer; and a protective film layer formed over said resistive film layer and said electrode pattern, wherein said resistive film layer is formed over an area of the groove, said electrode pattern is formed over the resistive film layer at the area of the groove, and said protective film layer is formed over the electrode pattern at the area of the groove.

10. A thermal head comprising:

(a) an upwardly convex partial-glaze layer formed over a top surface of an insulation substrate at one edge of the top surface of the insulation substrate, a first slope of said upwardly convex partial-glaze layer being steeper than a second slope of said upwardly convex partial-glaze layer;

(b) a resistive film layer formed over at least a top surface of said upwardly convex partial-glaze layer;

(c) an electrode pattern formed over said resistive film layer, a gap being formed in said electrode pattern over the top surface of said upwardly convex partial-glaze layer; and (d) a protective film layer formed over said resistive film layer and said electrode pattern, wherein a heating section is formed over the top surface of said upwardly convex partial-glaze layer, said heating section spanning a peak of the upwardly convex partial-glaze layer.

11. A printing apparatus comprising an image sensor outputting electrical signals corresponding to patterns on a document to be printed, means for supplying a sheet of printing paper, means for feeding an ink ribbon, and a thermal head responsive to the electrical signals to heat said ink ribbon and to print said patterns on the sheet of printing paper, said thermal head comprising:

(a) an upwardly convex partial-glaze layer formed over a top surface of an insulation substrate at one edge of the top surface of the insulation substrate, a first slope of said upwardly convex partial-glaze layer being steeper than a second slope of said upwardly convex partial-glaze layer;

(b) a resistive film layer formed over at least a top surface of said upwardly convex partial-glaze layer;

(c) an electrode pattern formed over said resistive film layer, a gap being formed in said electrode pattern over the top surface of said upwardly convex partial-glaze layer;

(d) a protective film layer formed over said resistive film layer and said electrode pattern, wherein a heating section is formed over the top surface of said upwardly convex partial-glaze layer, said heating section spanning a peak of the upwardly convex partial-glaze layer.

12. The printing apparatus of claim 11, wherein said sheet of printing paper is supplied to the thermal head in a direction from the first slope of said upwardly convex partial-glaze layer toward the second slope of said upwardly convex partial glaze layer.

13. A printing apparatus comprising an image sensor outputting electrical signals corresponding to patterns on a document to be printed, means for supplying a sheet of printing paper, means for feeding an ink ribbon, and a thermal head responsive to the electrical signals to heat said ink ribbon and to print said patterns on the sheet of printing paper, said thermal head comprising:

an insulation substrate having a top surface extending in a first direction of the insulation substrate, a second direction being perpendicular to the top surface;

an at least partially trapezoidal partial-glaze layer formed on the top surface of the insulation substrate at one edge of the top surface of the insulation substrate;

a resistive film layer formed over at least a top surface of said at least partially trapezoidal partial-glaze layer;

an electrode pattern formed over said resistive film layer, a gap being formed in said electrode pattern over the top surface of said at least partially trapezoidal partial-glaze layer;

a protective film layer formed over said resistive film layer and said electrode pattern, wherein a heating section is formed over the top surface of said at least partially trapezoidal partial-glaze layer; and a trapezoidal groove formed in the insulation substrate on a side of said at least partially trapezoidal partial-glaze layer adjacent to a center of said insulation substrate and at a position corresponding to a base of said at least partially trapezoidal partial-glaze layer, said resistive film layer formed over an area of the trapezoidal groove, said electrode pattern formed over the resistive film layer at the area of the trapezoidal groove, and said protective film layer formed over the electrode pattern at the area of the trapezoidal groove.

14. The printing apparatus of claim 13, wherein said at least partially trapezoidal partial-glaze layer has a width, measured in the first direction, ranging between 300 microns and 1000 microns, and a height, measured in the second direction, ranging between 10 microns and 70 microns, said trapezoidal groove having a width, measured in the first direction, ranging between 0.1 mm and 10 mm and a depth, measured in the second direction, ranging between 10 microns and 300 microns.

15. A printing apparatus comprising an image sensor outputting electrical signals corresponding to patterns on a document to be printed, means for supplying a sheet of printing paper, means for feeding an ink ribbon, and a thermal head responsive to the electrical signals to heat said ink ribbon and to print said patterns on the sheet of printing paper, said thermal head comprising:

an insulation substrate having a top surface extending in a first direction of the insulation substrate, a second direction being perpendicular to the top surface;

an at least partially trapezoidal partial-glaze layer formed over the top surface of the insulation substrate at one edge of the top surface of the insulation substrate;

a resistive film layer formed over at least a top surface of said at least partially trapezoidal partial-glaze layer;

an electrode pattern formed over said resistive film layer, a gap being formed in said electrode pattern over the top surface of said at least partially trapezoidal partial-glaze layer;

a protective film layer formed over said resistive film layer and said electrode pattern, wherein a heating section is formed over the top surface of said at least partially trapezoidal partial-glaze layer; and a trapezoidal groove formed in the insulation substrate on a side of said at least partially trapezoidal partial-glaze layer adjacent to a center of said insulation substrate and at a position corresponding to a base of said at least partially trapezoidal partial-glaze layer said resistive film layer formed over an area of the trapezoidal groove said electrode pattern formed over the resistive film layer at the area of the trapezoidal groove, and said protective film layer formed over the electrode pattern at the area of the trapezoidal groove.

16. The printing apparatus of claim 15, wherein said at least partially trapezoidal partial-glaze layer has a width, measured in the first direction, ranging between 300 microns and 1000 microns, and a height, measured in the second direction, ranging between 10 microns and 70 microns, said trapezoidal groove having a width, measured in the first direction, ranging between 0.1 mm and 10 mm and a depth, measured in the second direction, ranging between 10 microns and 300 microns.

17. A process of producing a thermal head comprising the steps of:

(a) forming an upwardly convex curved partial-glaze layer over an insulation substrate;

(b) forming an at least partially trapezoidal portion in said partial-glaze layer by etching said upwardly convex curved partial-glaze layer at opposite sides of the upwardly convex curved partial-glaze layer;

(c) rounding at least one corner of said at least partially trapezoidal portion;

(d) forming a resistive film over at least a top surface of said upwardly convex curved partial-glaze layer;

(e) forming an electrode pattern over said resistive film, a gap being formed in the electrode pattern over the top surface of said upwardly convex curved partial-glaze layer; and (f) forming a protective film layer cover said resistive film and said electrode pattern.

18. A process of making a thermal head, said process comprising:

(a) forming an upwardly convex curved partial-glaze layer over a top surface of an insulation substrate at one edge of the top surface of the insulation substrate;

(b) forming a groove in said insulation substrate on a side of said upwardly convex curved partial-glaze layer adjacent to a center of said insulation substrate at a position corresponding to a base of said upwardly convex curved partial-glaze layer;

(c) rounding at least one corner of said groove;

(d) forming a resistive film layer over at least said upwardly convex curved partial-glaze layer and said groove;

(e) forming an electrode pattern over said resistive film layer, a gap being formed in the electrode pattern over a top surface of said upwardly convex curved partial-glaze layer; and (f) forming a protective film layer over said resistive film layer and said electrode pattern, wherein said resistive film layer is formed over an area of the groove, said electrode pattern is formed over the resistive film layer at the area of the groove, and said protective film layer is formed over the electrode pattern at the area of the groove.

19. A process of making a thermal head said process comprising:

(a) forming an upwardly convex partial-glaze layer over a top surface of an insulation substrate at one edge of the insulation substrate;

(b) cutting said upwardly convex partial-glaze layer to form a the first slope steeper than a second slope;

(c) rounding a corner of said first slope;

(d) forming a resistive film layer over at least a top surface of said upwardly convex partial-glaze layer;

(e) forming an electrode pattern over said resistive film layer, a gap being formed in said electrode pattern over the top surface of said upwardly convex partial-glaze layer; and (f) forming a protective film layer over said resistive film layer and said electrode pattern.

* * * * *